US005103796A

United States Patent [19]

Peck

[11] Patent Number: 5,103,796

[45] Date of Patent: Apr. 14, 1992

[54] ROTATING BOW RELEASE

[75] Inventor: Paul L. Peck, Fond du Lac, Wis.

[73] Assignee: Tru-Fire Corporation, North Fond du Lac, Wis.

[21] Appl. No.: 518,983

[22] Filed: May 4, 1990

[51] Int. Cl.[5] ..... F41B 5/18

[52] U.S. Cl. ..... 124/35.2

[58] Field of Search ..... 124/35.2, 35.1

[56] References Cited

U.S. PATENT DOCUMENTS 4,257,386 3/1981 Gazzara .
4,485,798 12/1984 Hamm ..... 124/35.2
4,527,536 7/1985 Smith .
4,620,523 11/1986 Peck ..... 124/35.2
4,625,705 12/1986 Willits ..... 124/35.2
4,691,683 9/1987 Peck ..... 124/35.2
4,854,293 8/1989 Roberts ..... 124/35.2
4,881,516 11/1989 Peck ..... 124/35.2
4,926,835 5/1990 Peck ..... 124/35.2
4,982,718 1/1991 Hamm et al. ..... 124/35.2

*Primary Examiner*—Peter M. Cuomo
*Attorney, Agent, or Firm*—Andrus, Sceales, Starke & Sawall

[57] ABSTRACT

A bow string release includes a head with a string retaining sear and a grip with a trigger, each mounted on a cylindrical shaft such that head and grip are rotatable 360° relative to one another. One embodiment includes a flexible, collapsible latch release.

11 Claims, 3 Drawing Sheets

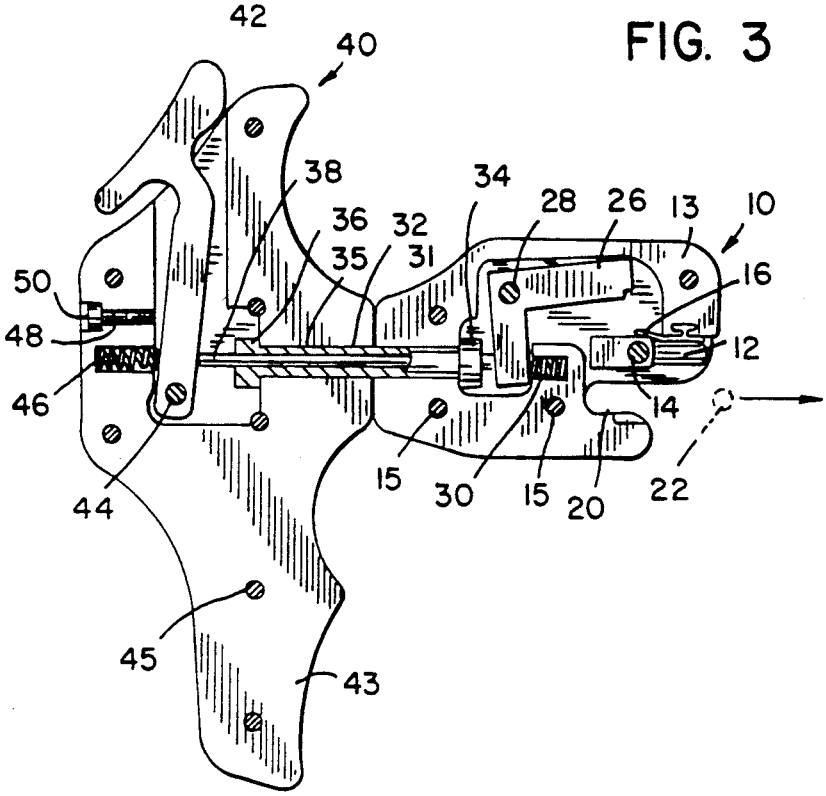
FIG. 3
FIG. 4
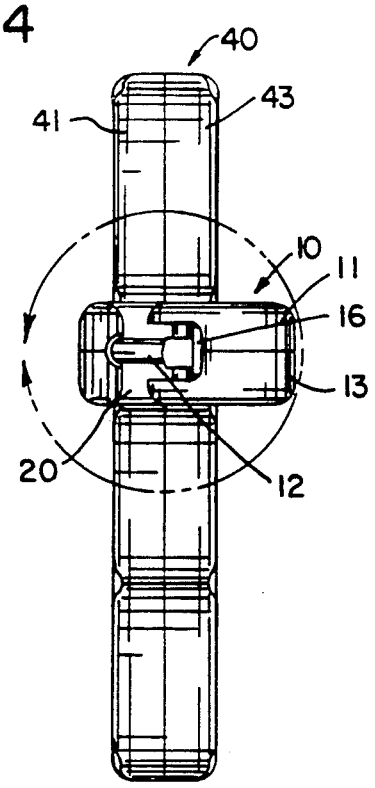
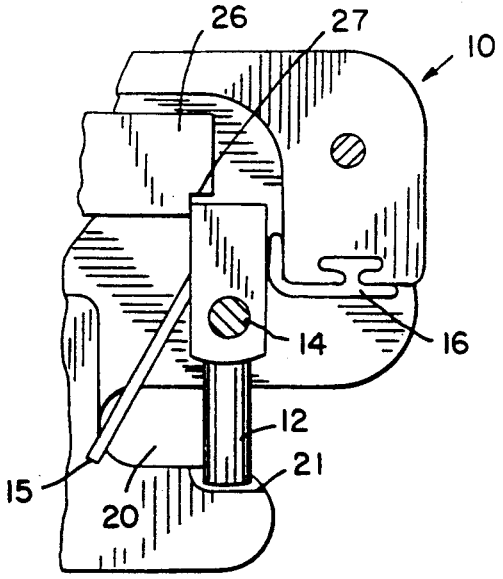
FIG. 5

ROTATING BOW RELEASE

BACKGROUND OF THE INVENTION

1. Field of the Invention

This invention relates to bow string releases of the type having a releasable sear for retaining a bow string, the sear being held in locked position by a latch which is released in response to activation of a trigger mechanism.

2. Description of the Prior Art

Bow string releases have grown in popularity for target shooting and for hunting. A good release provides uniform release of the bow string and increases accuracy. A release should provide for adjustment of the trigger stroke and should allow for adjustment of the relative angular relationship between the handle or grip and the bow string. Examples of such types of releases are shown in U.S. Pat. Nos. 4,485,798, 4,527,536 and 4,854,293.

The object of the present invention is to provide for a release having independent adjustment of the stroke and angular relationship of the grip relative to the bow string, utilizing a simple and inexpensive design not previously available.

SUMMARY OF THE INVENTION

The bow string release of the present invention provides a simple, inexpensive mechanism which includes a head with a string retaining mechanism such as a sear for retaining the bow string and a trigger for releasing the sear. The trigger and the head are mounted on a singular shaft and are rotatable 360° relative to one another, while being fully operational at any desired angular displacement.

The shaft is a hollow tubular member through which the latching mechanism is carried for communicating the trigger with the sear in the head. The latch mechanism is normally biased in the closed position to provide a positive lock for maintaining the sear in a latched condition. This permits sensitive adjustment of the trigger while minimizing risk of misfire.

In one embodiment, an L-shaped latch is used to gain a greater mechanical advantage for releasing the sear while minimizing the movement required of the trigger.

The features of the invention may be utilized in either a full hand-held (pistol grip) type or a three-finger style (thumb trigger) release. The invention is also adaptable for either a standard sear or a self-locking sear design.

The advantages and features of the invention will be more readily understood by reference to the drawings and detailed description which follow.

DESCRIPTION OF THE DRAWINGS

FIG. 3 shows the release mechanism as oriented in FIG. 2, in the unlatched position.

FIG. 4 is an enlarged frontal view of the release mechanism taken at arrows 4—4 of FIG. 1.

FIG. 5 is a partial, enlarged view of the release mechanism as shown in FIG. 2.

DESCRIPTION OF THE PREFERRED EMBODIMENTS

Figure 1:
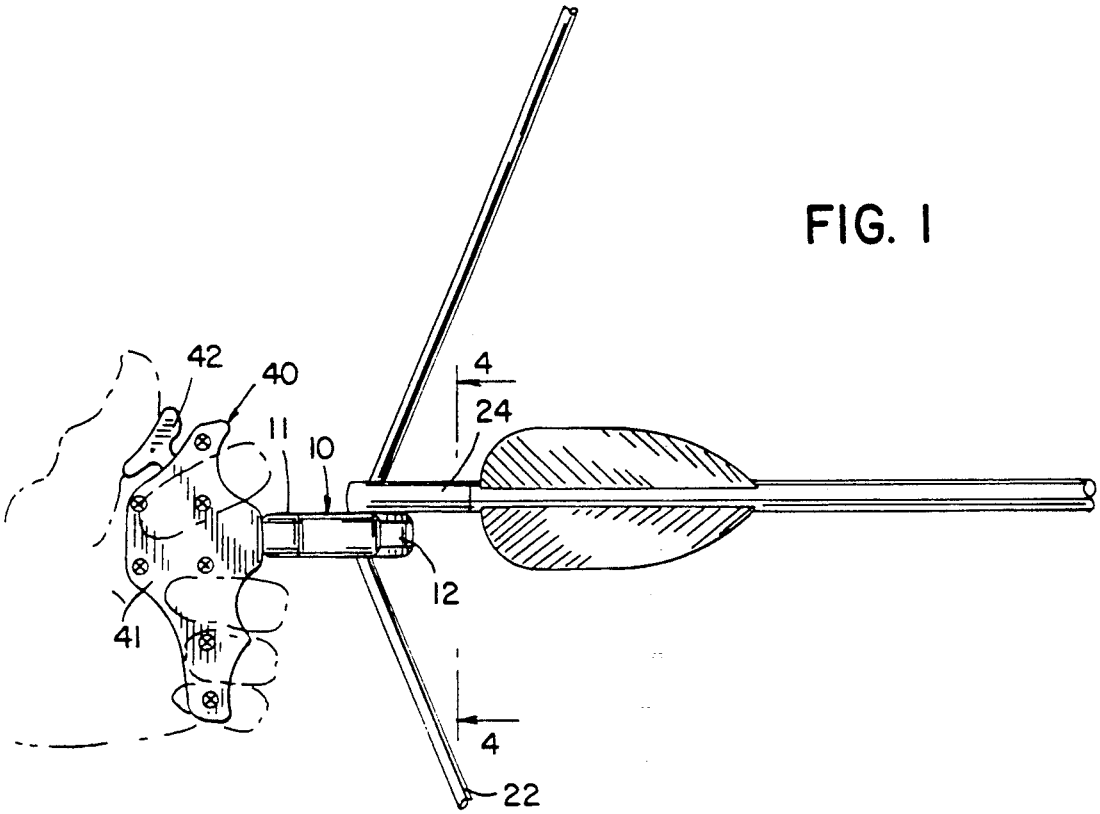
FIG. 1 is an illustration of the fully assembled bow string release mechanism as loaded and ready for release.

As shown in FIG. 1, the bow string release mechanism of the present invention is compact and designed to easily fit in the palm of the hand, comprising a head 10 a body 40 and a trigger. The trigger may comprise a thumb actuated release as shown at 42 of FIG. 1 or may be a pistol type release 142 shown in FIG. 6.

Bow string 22 is held in head 10 by sear 12. The head 10 also serves as a rest for arrow 24. When the trigger release 42 is pushed forward, sear 12 is unlatched and the bow string is released. The finger extension 15 on sear 12 provides a string engaging and return feature which makes the sear auto-locking upon reload.

Figure 2:
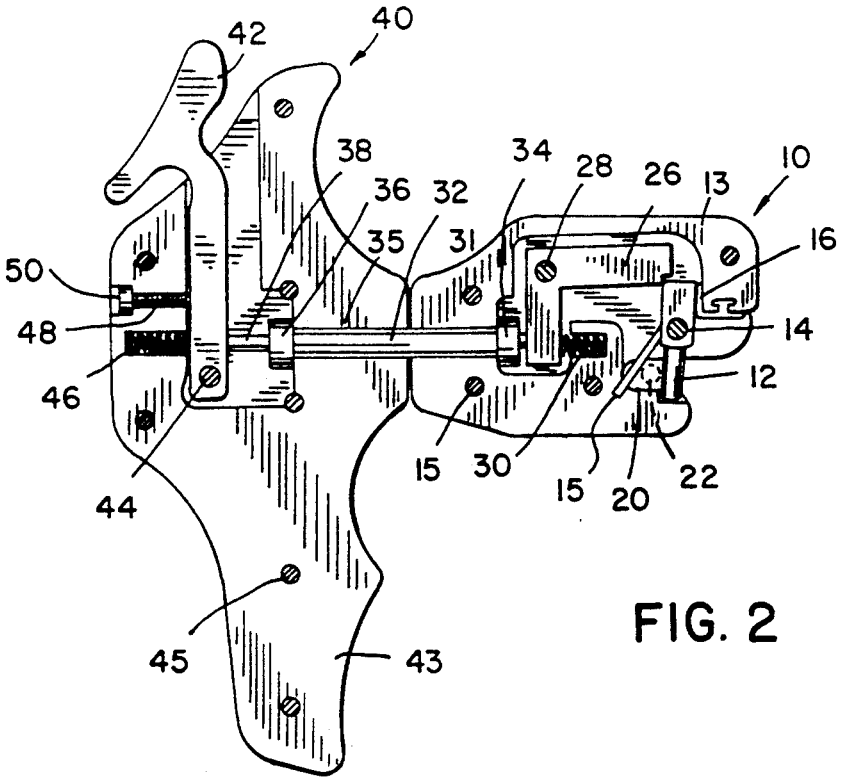
FIG. 2 shows a release mechanism of FIG. 1 in the latched position with the head rotated 90° into coplanar alignment with the grip and with the cover plates removed.

The release mechanism is shown in FIG. 2 with the head cover 11 and the grip cover 41 removed. The covers 11 and 41 are normally secured to the head base 13 and the grip base 43 by screws or fasteners 15 and 45, respectively, for encapsulating the various components of the mechanism. The head base, grip base and covers may each be molded of unitary construction, thus making the release mechanism less expensive to manufacture than many comparable systems now available.

The head 10 contains a sear 12 totally mounted to the head at post 14 and a latch element 26 pivotally mounted at post 28. A string receiving notch 20 is provided in the head. When the latch element 26 is in the latched position (FIG. 2), the sear 12 is closed to retain the string in notch 20. Spring 30 is carried in a suitable recess provided in the head and is in compression to normally bias the latch element into the latched position. As can be better seen in FIG. 5, the sear engaging end of the latch element includes a notch 27 for positively engaging the sear and holding it in the recess 21 adjacent string notch 20 when in the locked position. A resilient guard 16 is mounted in the head 10 forward of the sear 12. The guard serves to open the sear automatically once the latch is pushed forward, thus holding the sear in that position even after the string is released. It also provides a cushioned stop to limit movement of the sear into both the latched position (FIGS. 2 and 5) and the unlatched position (FIG. 3).

Head 10 includes a channel 31 adapted to receive and slidably engage the mounting spool 32. Grip 40 has a similar channel 35 which likewise receives and engages the mounting spool 32. Enlarged ends 34 and 36 of the spool 32 fit into the recesses provided in head 10 and grip 40, respectively, to retain the head and grip in axial position on the shaft 32. The covers 11 and 41 are installed to hold the head 10 and the grip 40 on the spool 32.

The head and grip are rotatable relative to one another a full 360°, as shown in FIG. 4. Both or either of the head and grip are mounted in the spool 32 in such a manner as to rotate with the desired friction to permit free movement while assuring that once the desired angular relationship between the head and grip is achieved, the head and grip will stay in place during use. If desired, clamping means may be provided to clamp the head and grip in the desired angular alignment.

The spool 32 is a hollow tubular member adopted for receiving the latch release mechanism such as the trigger or push pin 38 (FIG. 2). The ends of the push pin extend beyond the enlarged ends 34 and 36 of the shaft. A trigger release 42 is pivotally mounted on post 44 in the recess provided in the grip base. One end of pin 38 engages the trigger release 42 and the other end engages the latch element 26. As the trigger release is urged forward, the pin 38 pushes against latch element 26, overcoming the force of spring 30, lifting the front end of the latch and releasing the sear 12.

A second spring 46 is placed in the recess provided in the grip base 43, at the side of trigger release 42 opposite the pin 38. The forces of springs 30 and 46 are balanced to keep the latch 26, pin 38 and trigger release 42 in balance and biased toward the latched position, while providing an acceptable trigger feel to the user. The threaded hole 48 is provided in the grip base 43 to accept adjusting screw 50. The screw may be set to adjust the amount of travel required of the trigger to release the sear.

As shown in FIG. 3, as trigger release 42 is depressed, it pivots about post 44 and advances the pin 38 to pivot the L-shaped latch element 26, lifting notch 27 thereof and unlatching the sear 12 to release the bow string 22. As soon as the trigger 42 is released, it returns to the latched position and once the string 22 is reinserted in notch 20, the sear may be reset into latch notch 27, retaining the string until the trigger is again depressed.

Figure 6:
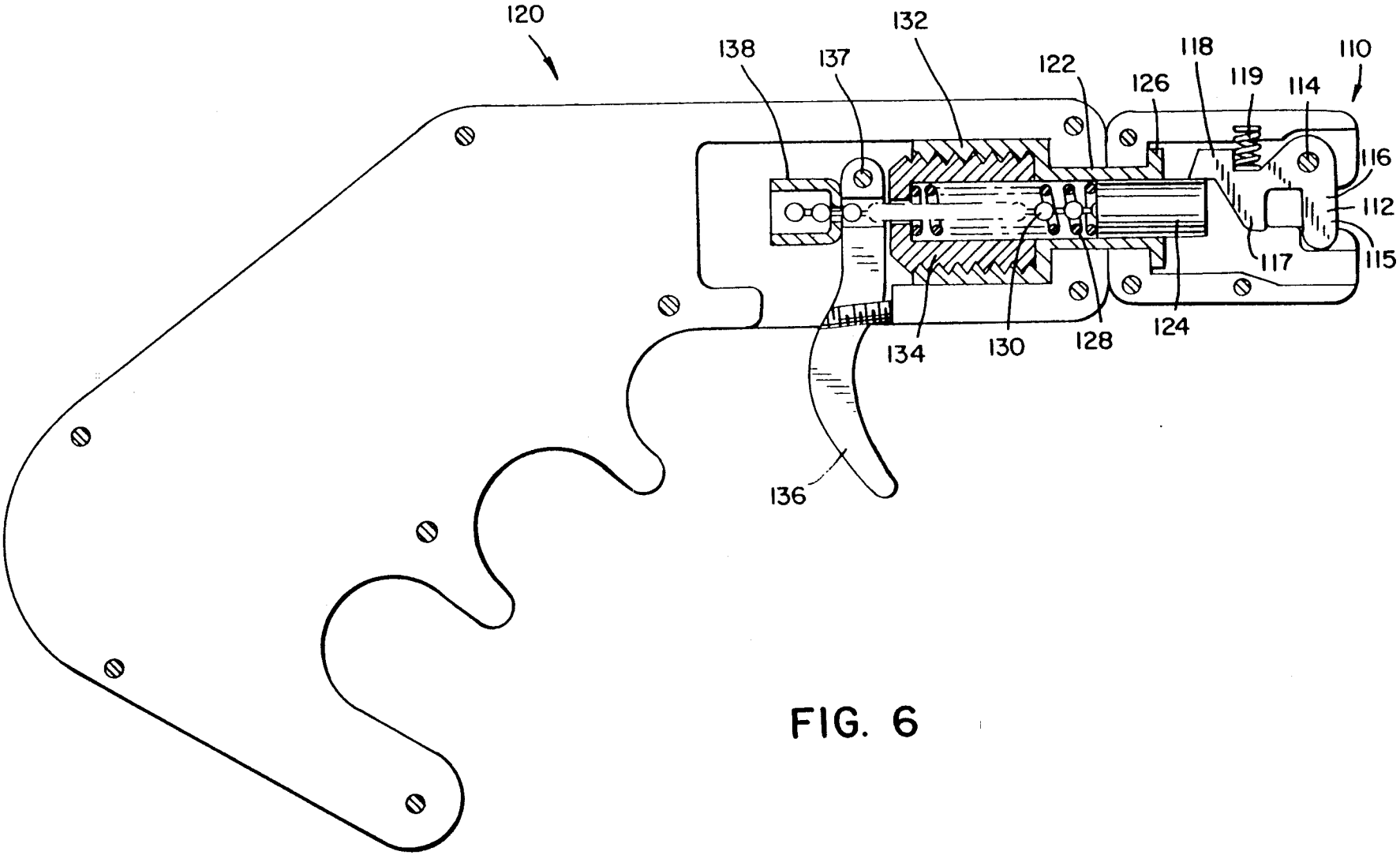
FIG. 6 is an alternative embodiment of a release mechanism according to the present invention, and oriented the same as the view of FIG. 2, with the cover plates removed.

An alternative embodiment of the release is shown in FIG. 6, with the covers removed. The orientation is the same as that shown in FIG. 2. The head 110 and grip 120 are mounted on a cylindrical, hollow mounting spool 122, as previously described, and are rotatable 360° relative to one another. The sear 112 is pivotally mounted at post 114 and a slot 115 is provided in the head to receive the bow string. The sear is in the shape of a "U" having legs 116 and 117, wherein leg 116 acts as the string retainer and leg 117, provides for automatic reloading and locking as will be described. Projection 118 extends outwardly from the base of leg 118 and engages a latch 124. A spring 119 seated in a suitable recess in the head and is normally in compression, biasing the sear into the unlatched position.

The latch release mechanism comprises a flexible, collapsible member such as the ball and chain 130 carried in the hollow spool 122, the latch 124 secured to one end of the ball and chain for engaging the projection 118 of the sear when in the normal, latched position. The opposite end of the ball and chain is secured to the trigger 136 by means of a locking pad 138 or the like. An enlarged end 132 is provided on the spool 122 to receive a retainer 134. A compression spring 128 is located inside spool 122 with opposite ends engaging the retainer 134 and the latch 124 to normally bias the trigger, ball and chain, and latch into the latched position. The enlarged ends 126 and 132 serve to maintain the head 110 and grip 120 in position on the spool 122, as with the previously described embodiment.

The trigger comprises a pistol grip 120 and the trigger release 136 is mounted to extend downward in the manner of a pistol trigger. The trigger release is pivotably mounted at post 137 and when pulled pivots back, pulling the ball and chain 130 and the latch 124 against spring 128, releasing projection 118 and unlatching sear 112, whereby the bow string is released. The trigger could also be directly mounted on the ball and chain, rather than on post 137. This would permit the trigger to operate when pulled by pulling the chain and trigger simultaneously in a sliding motion. The trigger and latch mechanism are returned to the biased latching position as soon as the trigger is released.

Once unlatched and the string is released, the sear 112 stays in the unlatched position, being urged in that direction by spring 119. Leg 117 is pivoted outward as the string releases and is adapted for receiving the string as it is reinserted in the sear. As the string is reinserted, it engages leg 117 and pivots the sear back into the latched position, pivoting upward and being latched into position by the biased latch 124. The bow string is now reloaded and will again be released when the trigger release is pulled. A set screw 140 may be provided to adjust the trigger travel to the individual requirements of each user.

The release mechanisms here shown may be adapted to many configurations including both strap and grip type and a variety of head and sear mechanisms. While particular embodiments of the invention have been shown and described, it will be readily understood that the invention includes all modifications and alternatives that are within the scope and spirit of the appended claims.

What is claimed:

1. A bow string release mechanism comprising a head, a body and a trigger, the head including string retaining means movable between a latched position for selectively receiving and retaining a bow string and an unlatched position for releasing the bow string, and a releasable latch for selectively holding the string retaining means in a latched position, the trigger mounted in the head and communicating with the latch for selectively unlatching the string retaining means and releasing the string, the release mechanism further comprising:

a. a hollow, cylindrical mounting spool;

b. means for mounting the head on the spool;

c. means for mounting the body on the spool adjacent to the head, the head and body mounted for rotational movement relative to one another about the axis of the spool;

d. latch release means extending through the hollow spool for communicating the trigger with the latch for selectively moving the latch from a latched position to an unlatched position;

e. said latch further comprising an L-shaped lever pivotally mounted in the head, one leg of the L in positive engagement with the latch release means, and the other leg of the L in positive locking engagement with the string retaining means when in the latched position, whereby movement of the latch release means axially in said spool by activation of said trigger permits pivotal movement of the latch to the unlatched position for unlatching said string retaining means; and f. biasing means in communication with the latch release means for normally biasing the latch in the latched position.

2. The release mechanism of claim 1, the latch release means comprising a push pin slidably carried by the mounting spool and extending beyond the opposite ends thereof, the opposite ends of said push pin engaging the trigger and the latch, for directly translating movement of the trigger to the latch.

3. The release mechanism of claim 1, wherein the body comprises a handle and the trigger is pivotally mounted in the handle, and further including second biasing means mounted in the handle for normally biasing the trigger into positive engagement with the push pin.

4. The release mechanism of claim 3, including means for adjusting the position of the trigger relative to the push pin.

5. The release mechanism of claim 1, the head including a resilient stop member for limiting the movement of the sear toward both the latched and unlatched positions and for normally holding the sear in the open position when unlatched.

6. A bow string release mechanism of the type having a body, a head and a trigger in the head, the head further including a sear movable between a latched position for receiving and retaining a bow string and an unlatched position for releasing the bow string, a latch for selectively holding the sear in the latched, string retaining position, and a latch release means for selectively unlatching the sear and latch, the mechanism further comprising:

a. a hollow cylindrical mounting spool;

b. means for mounting the head on the spool;

c. means for mounting the body on the spool adjacent to the head, the head and body mounted for rotational movement relative to one another about the spool;

d. the latch further including a latch element positioned substantially in the head and in positive engagement with the sear;

e. said latch release means further comprising an elongate, flexible, collapsible latch activator extending through the hollow spool and having opposite ends connected to the latch element and the trigger for communicating the trigger with the latch element; and f. biasing means arranged within the spool and in communication with the latch activator for normally placing the latch activator in tension between the latch element and the trigger and for normally biasing the latch element in the latch position.

7. The release mechanism of claim 6, wherein the latch activator comprises a ball and chain.

8. The release mechanism of claim 6, wherein said biasing means comprises a compression spring member being located in the spool and engaging the latch element for normally biasing the latch activator in tension.

9. The release mechanism of claim 8, including adjusting means in communication with the trigger for adjusting the tension on the latch activator.

10. The release mechanism of claim 6, wherein the sear comprises a modified U-shaped member pivotally mounted in the head at the base of the U, one leg of the U including a tab projecting outward from the leg for engaging the latch when in the latched position, one leg of the U defining a retainer for retaining the bow string when the sear is in the latched position and the other leg of the U defining a string receiving member for engaging the string and returning said sear to the latched position when the string is inserted into the release mechanism.

11. The release mechanism of claim 6, wherein the trigger is mounted on the latch activator and located in the body.

* * * * *